US006267170B1

(12) United States Patent
Onuki et al.

(10) Patent No.: US 6,267,170 B1
(45) Date of Patent: Jul. 31, 2001

(54) MANUFACTURING APPARATUS AND METHOD FOR AMORPHOUS ALLOY

(75) Inventors: Masahide Onuki, Miki; Hisashi Kakiuchi, Akashi; Akihisa Inoue, Sendai, all of (JP)

(73) Assignees: Sumitomo Rubber Industries, Ltd., Hyogo; Akihisa Inoue, Miyagi, both of (JP)

( * ) Notice: Subject to any disclaimer, the term of this patent is extended or adjusted under 35 U.S.C. 154(b) by 0 days.

(21) Appl. No.: 09/476,209

(22) Filed: Dec. 30, 1999

(51) Int. Cl.[7] ..... B22D 18/00; B22D 23/06

(52) U.S. Cl. ..... 164/80; 164/113; 164/136; 164/495

(58) Field of Search ..... 164/80, 113, 136, 164/284, 319, 495, 508; 249/135

(56) References Cited

U.S. PATENT DOCUMENTS 5,720,246 * 2/1998 Griffin et al. ..... 123/90.61

5,799,717 * 9/1998 Aoshima et al. ..... 164/271

FOREIGN PATENT DOCUMENTS 0 895 822 2/1999 (EP) .

3-275268 * 12/1991 (JP) .

* cited by examiner

*Primary Examiner*—Kuang Y. Lin

(74) *Attorney, Agent, or Firm*—Armstrong, Westerman, Hattori, McLeland & Naughton LLP

(57) ABSTRACT

A metal mold is composed of a lower mold having a portion for fusing metal material and a cavity portion, and an upper mold working with the lower mold which presses molten metal in the portion for fusing metal material and pours the molten metal into the cavity portion to mold. And, the portion for fusing metal material is composed of a material having a heat conductivity equal to or less than 250 kcal/(m·h·° C.).

4 Claims, 10 Drawing Sheets

MANUFACTURING APPARATUS AND METHOD FOR AMORPHOUS ALLOY

BACKGROUND OF THE INVENTION

1. Field of the Invention

This invention relates to a manufacturing apparatus and method for amorphous alloy.

2. Description of the Related Art

Recently, amorphous alloys having very low critical cooling rates of 1 to 100 K/s have been developed. These are, for example, amorphous alloys of Zr—Al—Co—Ni—Cu system, Zr—Ti—Al—Ni—Cu system, Zr—Ti—Nb—Al—Ni—Cu system, Zr—Ti—Hf—Al—Co—Ni—Cu system, Zr—Al—Ni—Cu system, etc. Among these alloys, Zr—Al—Ni—Cu system is regarded as especially preferable. And, accompanying these alloys, large (bulk) molded products of amorphous alloy are being produced with various methods. These methods are, for example, forging method in which molten metal is pressed and formed into a predetermined configuration, rolling method in which molten metal is rolled, and casting method in which molten metal is casted into a predetermined configuration.

In the above forging method and rolling method, for example, metal material is placed on a portion for fusing formed on a water-cooled copper mold, fused by arc discharge, etc., and, molten metal having a predetermined configuration on the mold is spread by an upper mold or filled into the mold (rolled) with a (forging) roll, and cooled over a critical cooling rate to form amorphous alloy. In these forging method and rolling method, contact pressure of the molten metal and the mold is high in comparison with the casting method for process of pushing the molten metal to the mold, very high cooling rate is obtained for high heat conductivity on contact portion, and good large (bulk) molded product of amorphous alloy having high super cooling degree is obtained.

However, to obtain better large (bulk) molded product of amorphous alloy, there are problems as follows.

① Although time between the fusing process and the pressing process has to be as short as possible because the forming has to be completed before the molten metal solidifies, heat of the molten metal is immediately absorbed by the mold when the arc discharge or electronic beam for fusing is stopped because the metal material is fused on the water-cooled copper mold, and temperature of the molten metal is rapidly decreased thereby.

② Alloy (the metal material) to be fused on the part where the alloy contacts the mold can not be fused because the alloy is fused on the water-cooled copper mold. That is to say, to fuse the alloy to be fused entirely without fusing the mold, high-level temperature control with which the temperature of the mold is not increased over the melting point of the mold is necessary, and this is practically difficult.

③ Although heat contact between the mold and the alloy to be fused is relatively bad, it is impossible to completely fuse an alloy having a melting point higher than that of the material of the mold.

For the problems of ①, ②, and ③, the temperature of the molten metal can not be high. This is a disadvantage in the above described point "the forming has to be completed before the molten metal solidifies".

④ Further, in case that the alloy is not fused completely, clusters (small groups of atoms of which disposition is similar to that of crystal), which may become crystal nuclei, are discharged from surface of the non-fused portion touching the mold. In forming of amorphous by rapid cooling over the critical cooling rate, it is extremely inconvenient that the molten metal includes the clusters which may become crystal nuclei.

⑤ On the other hand, although the alloy to be fused can be completely fused, with a mold having high melting point such as a mold made of carbon, heat conductivity is insufficient to cool the molten metal over the critical cooling rate, when the molten metal is filled into the mold.

It is therefore an object of the present invention to provide a manufacturing apparatus and method for amorphous alloy with which a good and large (bulk) molded product of amorphous alloy can be obtained easily and certainly.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 1:
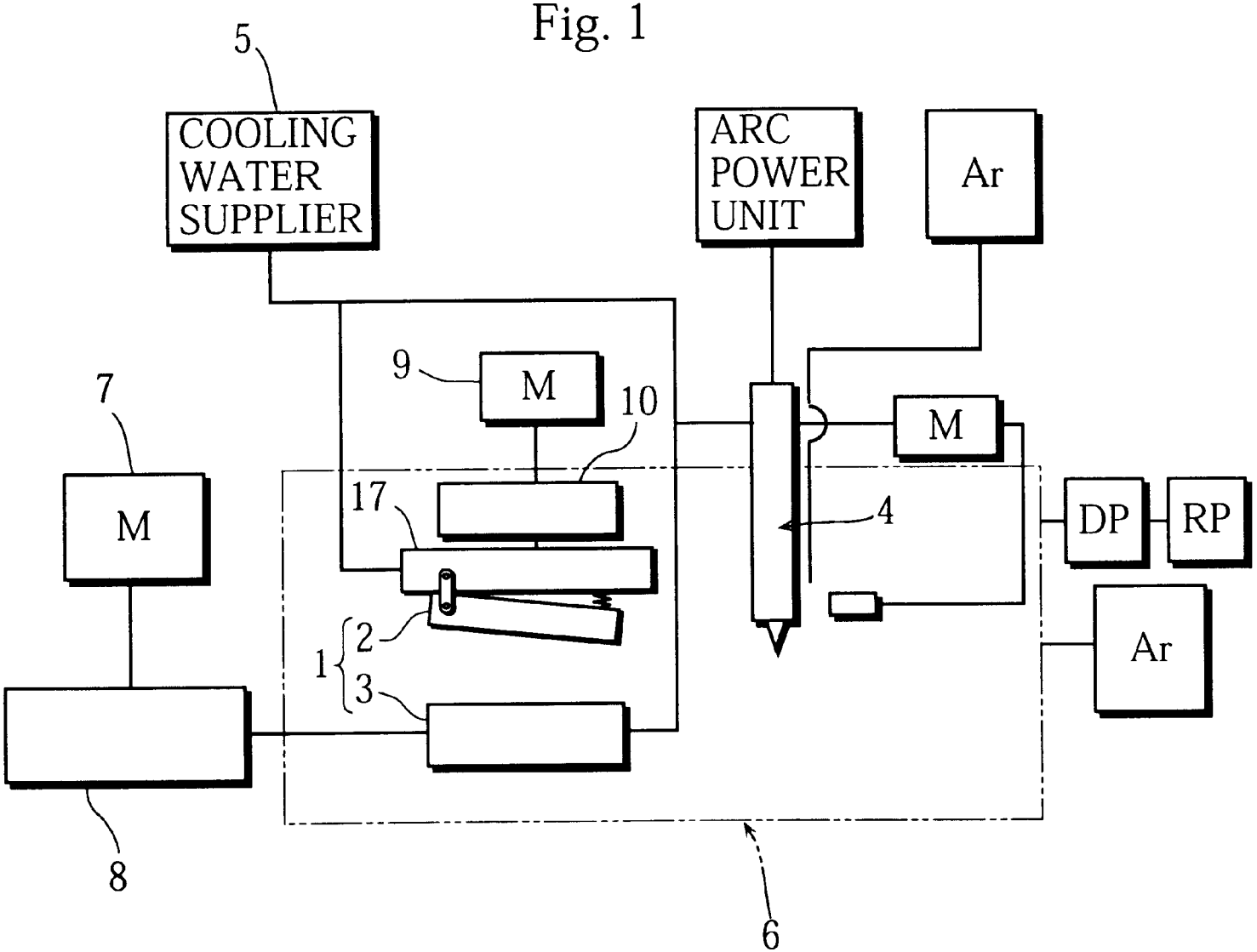
FIG. 1 is a schematic explanatory view of construction showing a preferred embodiment of the present invention.

FIG. 1 shows a preferred embodiment of a manufacturing apparatus for amorphous alloy of the present invention in which molten metal, obtained by fusing a metal material with high energy heat source which can fuse the metal material, is transformed into a predetermined configuration and cooled at over a critical cooling rate simultaneously with or after the transformation to be molded into the predetermined configuration.

To describe the construction concretely, the manufacturing apparatus for amorphous alloy of the present invention is provided with a mold 1 composed of an upper mold 2 and a lower mold 3, an arc power unit and an arc electrode (tungsten electrode) 4 as the high energy heat source for fusing metal material placed on the lower mold 3, a cooling water supplier 5 which circulates and supplies cooling water to the upper mold 2, the lower mold 3, and the arc electrode 4, a vacuum chamber 6 which stores the mold 1, the arc electrode 4, etc., a lower mold moving mechanism 8 driven by a motor T which moves the lower 3 in a horizontal direction, and an upper mold moving mechanism 10 driven by a motor 9 which moves the upper mold 2 in vertical direction.

Figure 2:
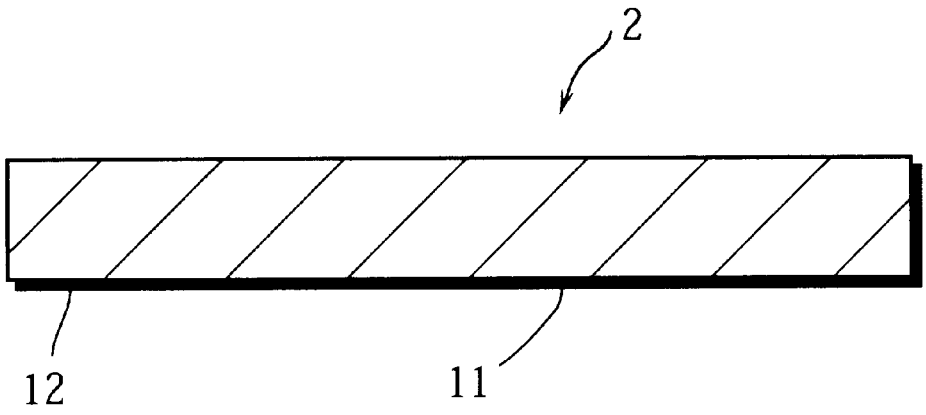
FIG. 2 is a cross-sectional front view showing an upper mold.
Figure 3:
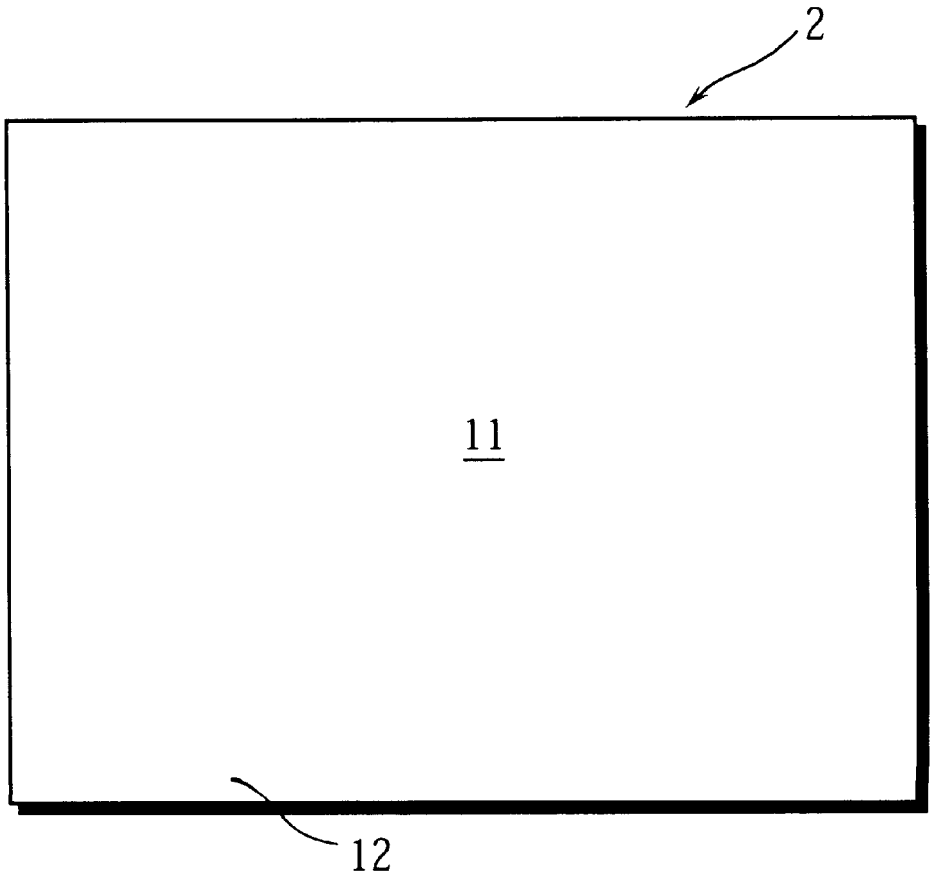
FIG. 3 is a bottom view showing the upper mold.

Then, as shown in FIG. 2 through FIG. 5, the mold 1 has a configuration without engagement portions on which the upper mold 2 and the lower mold 3 engage each other. Concretely, FIG. 2 is a cross-sectional front view and FIG. 3 is a bottom view of the upper mold 2. The upper mold 2 is formed into a rectangular flat plate with metal having high heat conductivity such as copper, copper alloy, silver, etc., and peripheral edge of a lower face of the upper mold 2 is a parting face 12.

Figure 4:
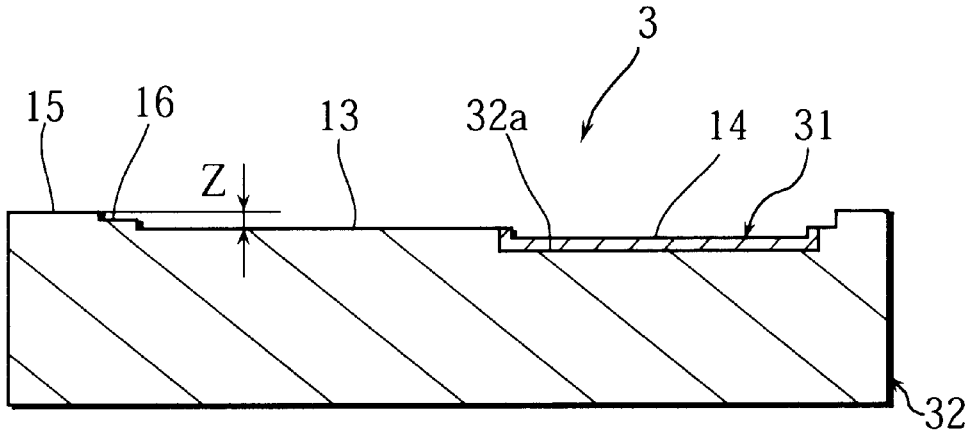
FIG. 4 is a cross-sectional front view showing a lower mold.
Figure 5:
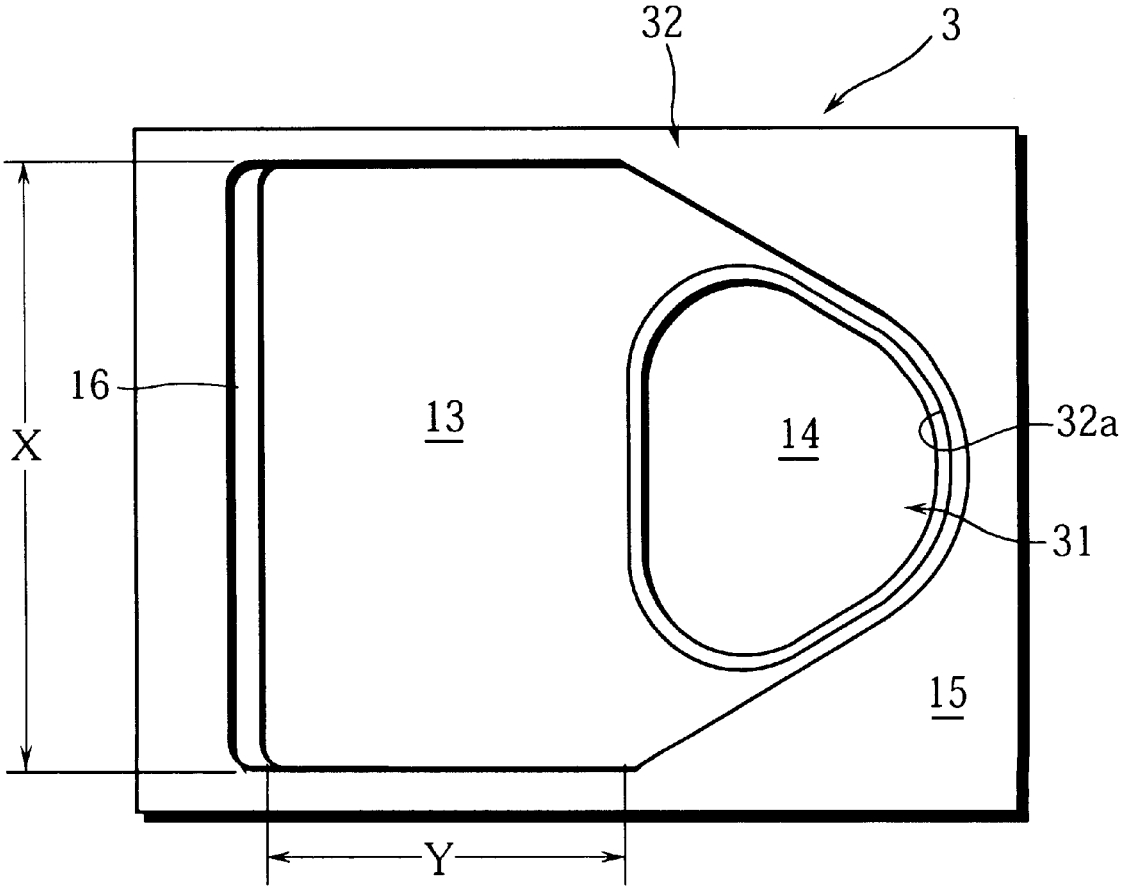
FIG. 5 is a plane view showing the lower mold.

FIG. 4 is a cross-sectional front view and FIG. 5 is a plane view of the lower mold 3. The lower mold 3 has a portion 14 for fusing metal material (a shallow triangular concave portion) on one end side of an upper face of the lower mold 3, and a cavity portion 13 on the other end side opposite to the portion 14. And, peripheral edge of an upper face of the lower mold 3 is a parting face 15 corresponding to the parting face 12 of the upper mold 2. And, the portion 14 forms a continuous face with the cavity portion 13.

And, a staged aperture forming portion 16 is formed along the parting face 15 on the other end side of the cavity portion 13, an aperture is formed between the upper mold 2 and the lower mold 3 by this aperture forming portion 16 when the metal mold is closed, and excessive molten metal is absorbed by the aperture. And, configuration of the portion 14 for fusing metal material extends to the cavity portion 13 as molten metal easily flows into the cavity portion 13.

Therefore, in the mold 1, the portion 14 for fusing metal material of the lower mold 3 is composed of a material having heat conductivity equal to or less than 250 kcal/(m·h·° C.), preferably equal to or less than 220 kcal/(m·h·° C.). In this case, a contact face of the portion 14 (surface of the shallow triangular concave portion) which contacts molten metal is composed of a material having heat conductivity equal to or less than 250 kcal/(m·h·° C.), preferably equal to or less than 220 kcal/(m·h·° C.). Further, the portion 14 is composed of a material of which melting point is equal to or more than 2000 ° C., preferably equal to or more than 3000 ° C.

As the material of the portion 14 for fusing metal material, among various materials such as $Al_2O_3$, CaO, MgO, $ZrO_2$, BN(boron nitride), graphite, graphite is the most preferable. That is to say, graphite, of which heat conductivity may change depending on crystal structure, having heat conductivity of 70 to 220 kcal/(m·h·° C.) and high melting point of over 3500 ° C., is the most preferable for the material of the portion 14. Further, fusing of molten metal by arc discharge is possible with graphite having high electric conductivity, and it is convenient that graphite hardly reacts to Zr system amorphous alloy.

And, the cavity portion 13 of the lower mold 3 is composed of a material having heat conductivity equal to or more than 270 kcal/(m·h·° C.), preferably equal to or more than 300 kcal/(m·h·° C.). In this case, a contact face of the cavity portion 13 which contacts the molten metal flowing from the portion 14 for fusing metal material, namely the face which contacts molded product of amorphous alloy, is composed of a material having heat conductivity equal to or more than 270 kcal/(m·h·° C.), preferably equal to or more than 300 kcal/(m·h·° C.). And, the cavity portion 13 is composed of a material of which melting point is equal to or more than 800 ° C., preferably equal to or more than 1000 ° C.

As the material for the cavity portion 13, materials having high heat conductivity and high melting point are preferable. That is to say, as the material for the cavity portion 13, among copper (heat conductivity 340 kcal/(m·h·° C.), melting point 1083 ° C.), copper alloy, silver (heat conductivity 370 kcal/(m·h·° C.), melting point 962° C.), gold (heat conductivity 270 kcal/(m·h·° C.), melting point 1064 ° C.), etc., copper, copper alloy, and silver are preferable in point that they have both of high heat conductivity and high melting point. And, copper and copper alloy are further preferable for their low cost.

If the cavity 13 is composed of a material having heat conductivity less than 270 kcal/(m·h·° C.), the molten metal flowing from the portion 14 into the cavity portion 13 becomes difficult to be cooled rapidly. And, if the cavity 13 is composed of a material having melting point less than 800 ° C., the cavity portion 13 itself may be deformed or melted.

The lower mold 3 of the mold 1 composed as described above, as shown in FIG. 4 and FIG. 5, is having a shallow dish member 31 made of graphite having a shallow triangular concave portion (in plane view), provided with a lower mold main body 32 having a concave portion 32*a* made of copper (or copper alloy, or silver) to which the shallow dish member 31 is fitted, and formed by fitting the shallow dish member 31 to the concave portion 32*a* of the lower mold main body 32 without a gap. And, a concave portion of the shallow dish member 31 is the portion 14 for fusing metal material. And, on a contact face portion where the shallow dish member 31 and the lower mold main body 32 contact each other, contact area of the shallow dish member 31 and the lower mold main body 32 may be reduced by roughing the surface roughness of a reverse face of the shallow dish member 31 or the surface of the lower mold main body 32, or making grooves on the surface of the shallow dish member 31 or the lower mold main body 32. By reducing the contact area of the shallow dish member 31 and the lower mold main body 32, the shallow dish member 31 is hardly deprived of heat, and consequently, temperature of the molten metal becomes higher(not shown in Figures). And, as shown in FIG. 1 and FIG. 4, the lower mold main body 32 is cooled by the cooling water supplier 5. That is to say, it is constructed as that the cavity portion 13 of the lower mold 3 is cooled.

Figure 6:
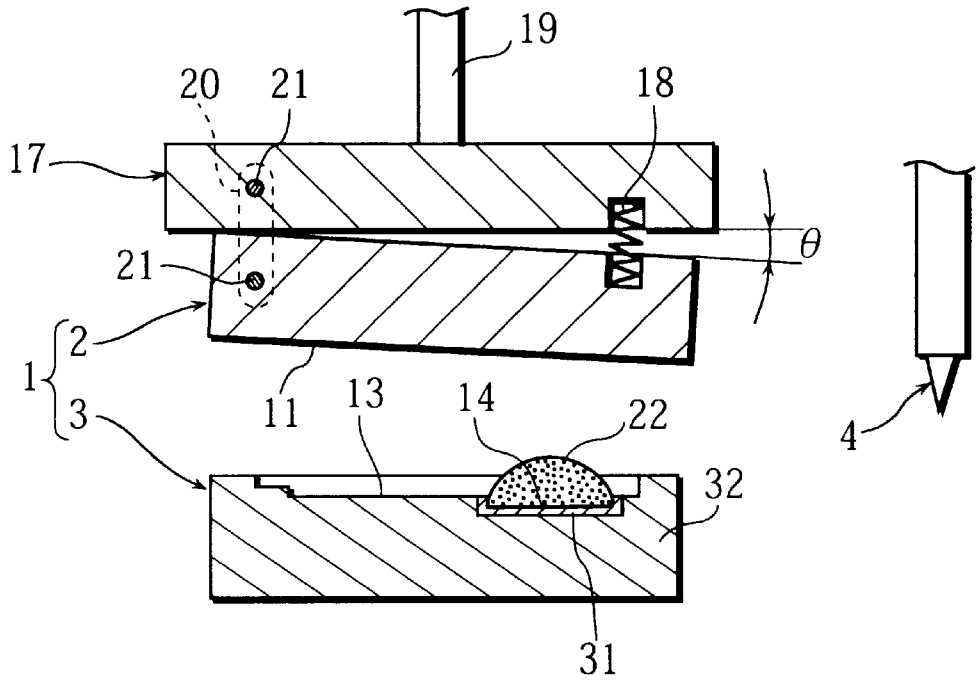
FIG. 6 is an enlarged cross-sectional front view of a principal portion showing a pre-forming state.

As shown in FIG. 1 and FIGS. 6, 19 is an elevation rod of the upper mold moving mechanism 10. An attachment member 17 for holding the upper mold 2 is attached to a lower end of the elevation rod 19 horizontally. And, the upper mold 2 is attached to a lower face side of the attachment member 17 as to be inclining. Concretely, an end side of the upper mold 2 and an end side of the attachment member 17 are connected with an elastic member 18 (a coil spring, for example), the other side of the upper mold 2 and the other side of the attachment member 17 are connected through oscillating pieces 20 (one of which is shown in FIG.

1 and FIG. 6) and supporting shafts 21, and the upper mold 2 is inclined for a relatively small inclination angle (1°, for example) by that the end side of the upper mold 2 is elastically pushed downward by the elastic member 18 (or weight of the upper mold 2 itself). And, the lower mold 3 is horizontal same as the attachment member 17.

Manufacturing method for amorphous alloy with the Manufacturing apparatus for amorphous alloy of the present invention constructed as described above is described below. First, as shown in FIG. 1 and FIG. 6, metal material 22 is placed on the portion 14 for fusing metal material of the lower mold 3.

Figure 7:
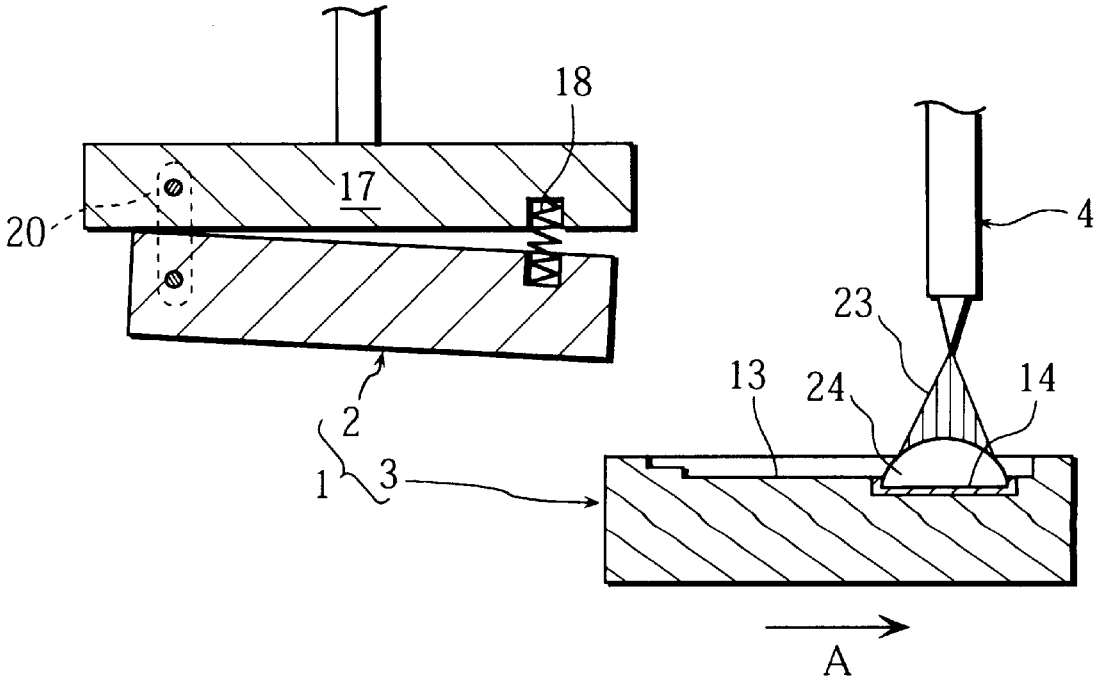
FIG. 7 is an enlarged cross-sectional front view of a principal portion showing a forming state of molten metal.

Next, as shown in FIGS. 1, 6, and 7, the lower mold 3 is moved in a horizontal direction (a direction shown by an arrow A) by the lower mold moving mechanism 8 driven by the motor 7, and stopped at a position below the arc electrode 4. And, the arc power unit is switched on, plasma arc 23 is generated from an end of the arc electrode to the metal material 22, and molten metal 24 is obtained by fusing the metal material 22 completely. In this case, the molten metal 24 is stopped to flow by the portion 14 for fusing metal material.

Figure 8:
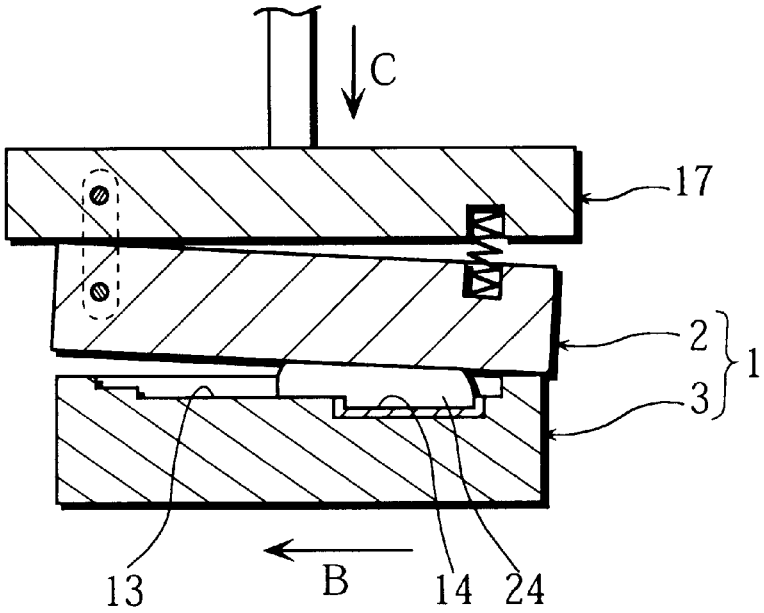
FIG. 8 is a cross-sectional front view of a principal portion showing a molded state.
Figure 9:
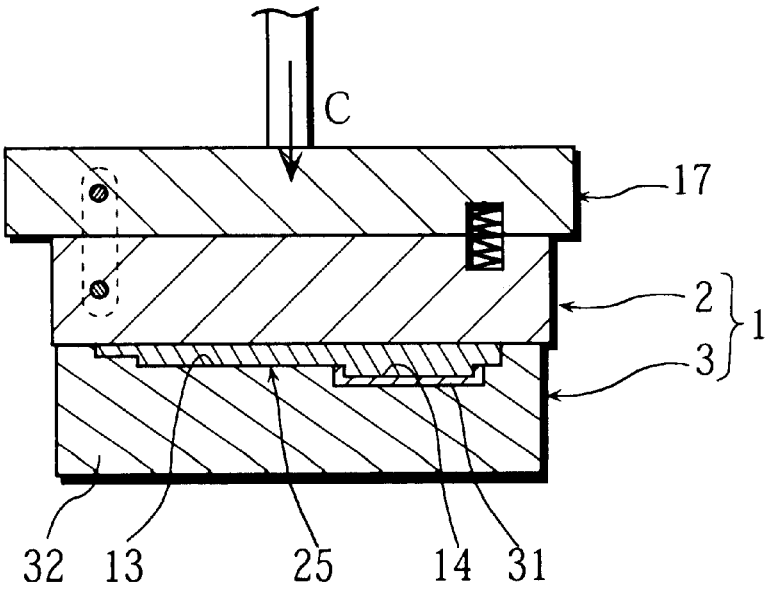
FIG. 9 is a cross-sectional front view of a principal portion showing a closed state of the mold.

Then, as shown in FIGS. 1, 7, and 8, the arc power unit is switched off and the plasma arc 23 is put off. And, the lower mold 3 is swiftly moved (in an arrow B direction) to a position below the upper mold 2, the upper mold 2 is descended (in an arrow C direction) by the motor 9 and the upper mold moving mechanism 10, the obtained molten metal 24 over the melting point is pressed by cooperation of the upper mold 2 and the lower mold 3 to be transformed into the predetermined configuration, the molten metal 24 is cooled by the cooled mold 1 over the critical cooling rate simultaneously with or after the transformation, and the molten metal 24 rapidly solidifies thereby and becomes a molded product of amorphous alloy 25 as shown in FIG. 9.

Figure 10:
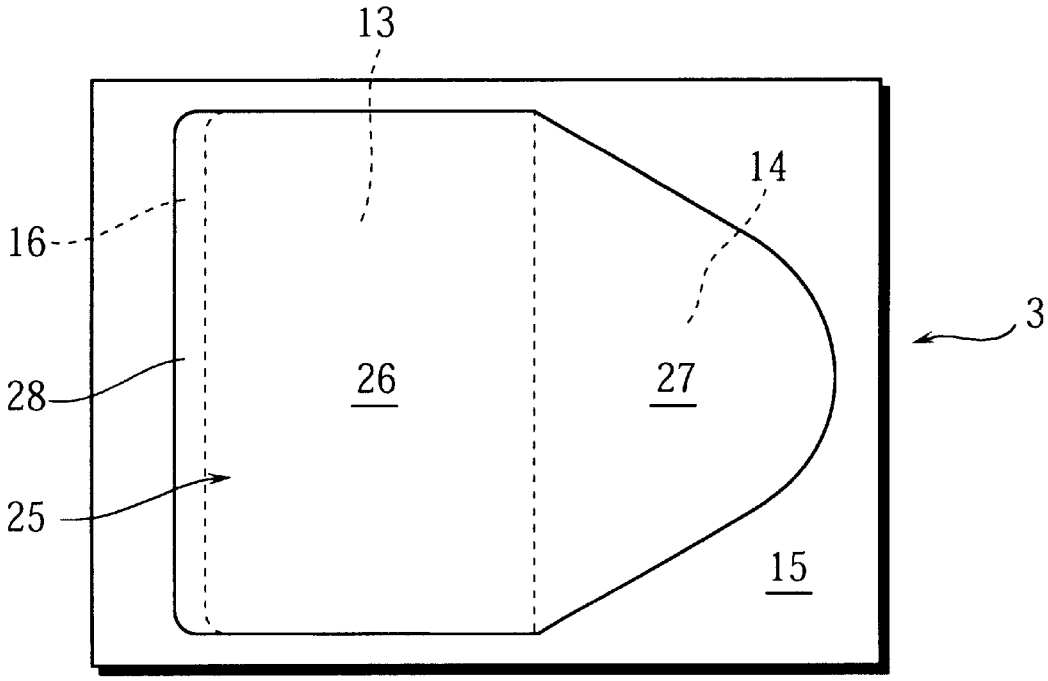
FIG. 10 is a plane view showing filling degree of the molten metal in a cavity portion of the lower mold.
Figure 11A:
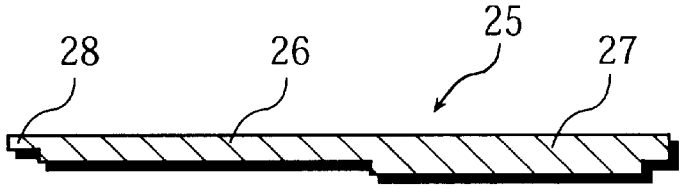
FIG. 11A is a cross-sectional front view showing a molded product of amorphous alloy.

In this case, as shown in FIG. 7 and FIG. 8, temperature decrease of the molten metal 24 over the melting point is greatly reduced (heat is hardly lost) during a period of time in which the lower mold 3 is moved to the press position (the position below the upper mold 2) after the arc discharge is switched off and the descended upper mold 2 contacts the molten metal 24, temperature decrease of the molten metal 24 over the melting point is greatly reduced (heat is hardly lost) because the portion 14 for fusing metal material of the lower mold 3 is made of graphite having low heat conductivity. And, the inclined upper mold 2 becomes horizontal to contact and press the molten metal 24 and the mold is closed, the molten metal 24 in good fluidity smoothly flows out of the portion 14 to fill the cavity portion 13 of high heat conductivity entirely, high cooling rate is obtained by rapid increase of contact area between the molten metal 24 and the mold 1, and, thin and large (bulk) molded product of amorphous alloy 25 as shown in FIG. 10 and FIG. 11A is obtained.

Figure 11B:
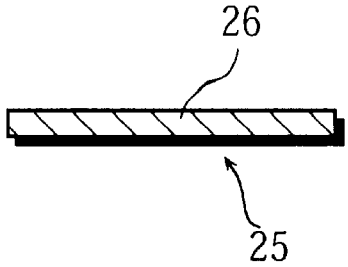
FIG. 11B is a cross-sectional front view showing a molded product of amorphous alloy.

And, in the molded product of amorphous alloy 25, 26 is a part corresponding to the cavity portion 13 of the lower mold 3, 27 is a part corresponding to the portion 14 for fusing metal material and its adjacent parts, 28 is a part corresponding to the aperture forming portion 16 (a flash), and the unnecessary parts 27 and 28 are removed with working such as cutting, polishing, etc. to finish the product as a product as shown in FIG. 11B.

And, in the present invention, not restricted to the embodiments described above, for example, the portion 14 for fusing metal material and the cavity portion 13 of the lower mold 3 may be formed in a curved concave configuration, and a curved convex portion may be formed on the lower face of the upper mold 2 to make a molded product of amorphous alloy 25 of curved plate.

EXAMPLES

Figure 12:
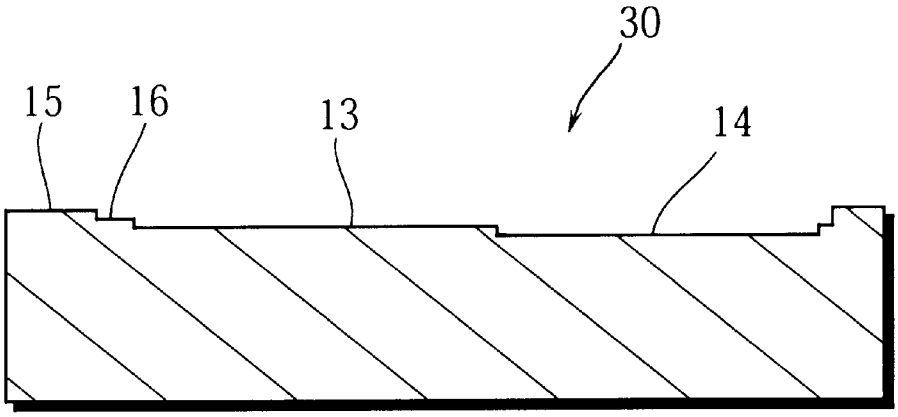
FIG. 12 is a cross-sectional front view showing another lower mold.
Figure 13:
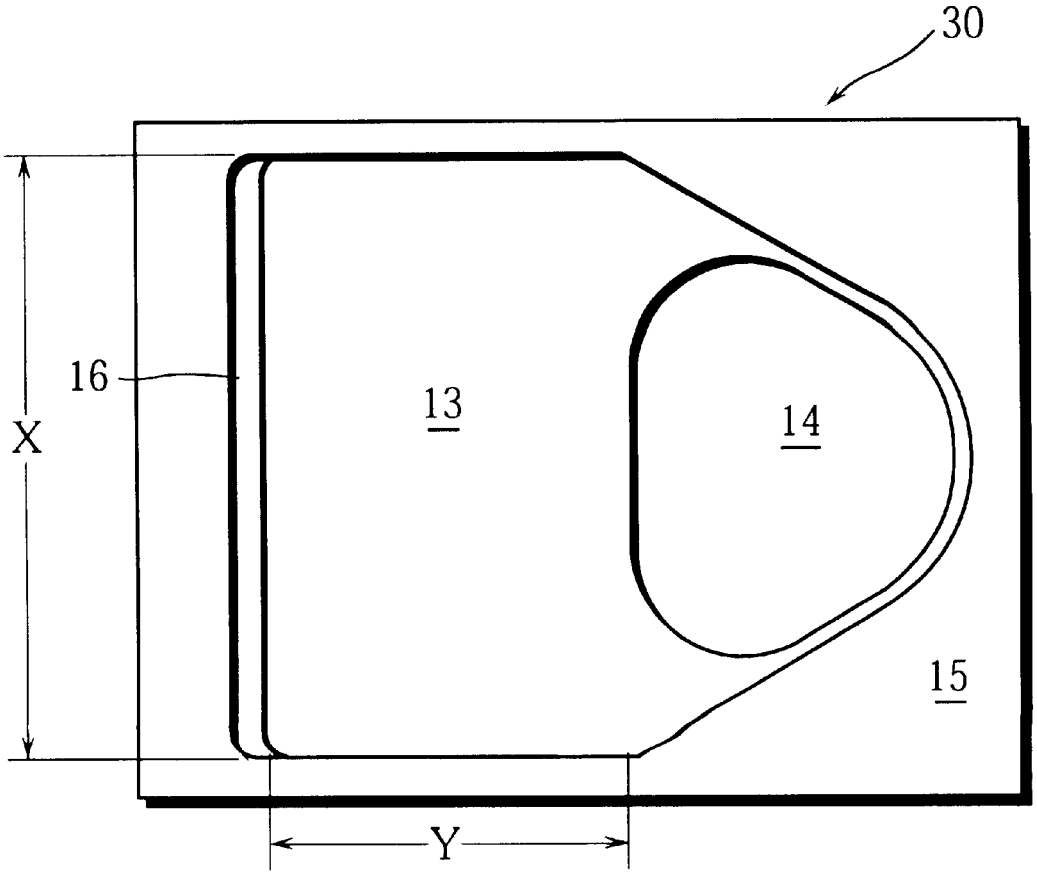
FIG. 13 is a plane view showing another lower mold.

Next, a concrete example of the present invention (the lower mold 3 described with FIG. 4 and FIG. 5), and a comparison example (a lower mold 30) shown in FIG. 12 and FIG. 13 were made under the conditions below.

(1) In the lower mold 3 of the example and the lower mold 30 of the comparison example, the cavity portion has length dimension X of 80 mm, width dimension Y of 50 mm, and thickness dimension Z of 2 mm.

(2) In the lower mold 3 of the example, the lower mold main body 32 is formed of oxygen free copper and the shallow dish member 31 having thickness of 2 mm is formed of graphite, namely, IG-11 made by TOYO TANSO CO., LTD. to make a carbon-compound copper mold, and the lower mold 30 of the comparison example is formed of oxygen free copper entirely (to be a copper mold).

Forming experiment was conducted on the example and the comparison example under the conditions below.

(3) The manufacturing apparatus of the present invention, described with FIG. 1, is used.

(4) The upper mold 2, formed of oxygen free copper into a rectangle flat plate as described with FIG. 2 and FIG. 3, is used in both of the example and the comparison example.

(5) An alloy, $Zr_{55}Al_{10}Ni_5$ $Cu_{30}$, is used as the metal material.

(6) The inclination angle θ of the upper mold 2 is 1° in a state before molding.

(7) The metal material is fused for 2 minutes by arc discharge (20V–300 A).

(8) Lower mold moving time, from switching off of the arc discharge to the press position, is 1.6 seconds, and closing time of the mold is 1.3 seconds.

The results of the forming experiment are shown in Table 1.

TABLE 1

| MOLD | SURFACE TEMPERATURE OF MOLTEN METAL | FLOWING OF MOLTEN METAL |
|---|---|---|
| EXAMPLE (carbon-compound copper mold) | 1500° C. | PERFECTLY FILLED |
| COMPARISON EXAMPLE (copper mold) | 1100° C. | IMPERFECT |

Figure 14:
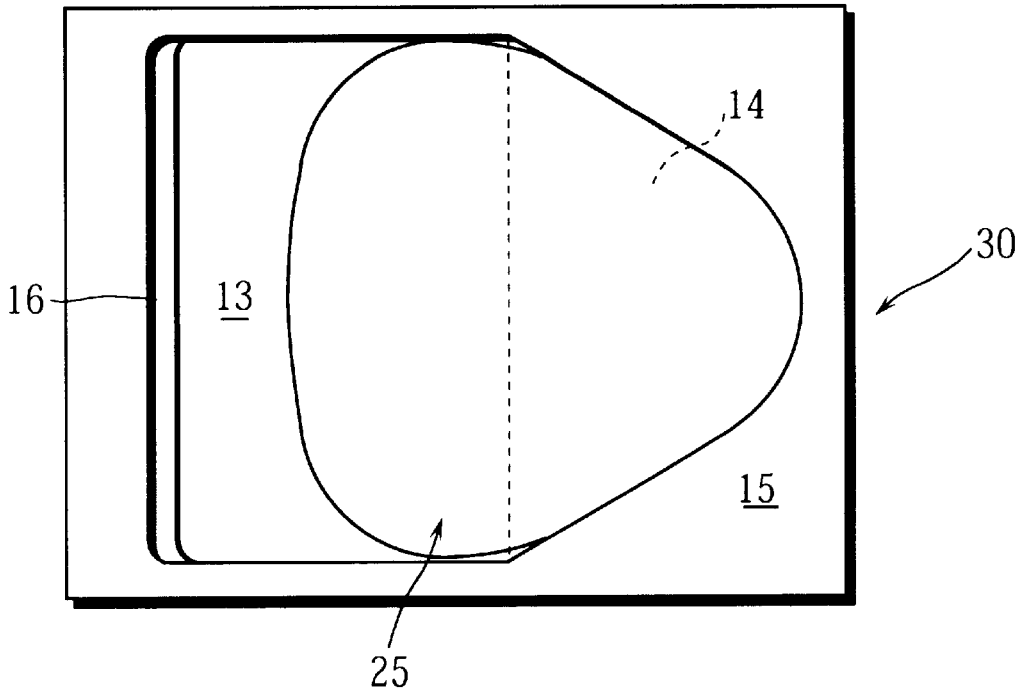
FIG. 14 is a plane view showing filling degree of the molten metal in a cavity portion of another lower mold.

Surface temperature of the molten metal measured with a radiation thermometer right after the switching off of the arc discharge shows that very high temperature of the molten metal is obtained in the example in comparison with the comparison example as shown in Table 1. And, while the cavity portion 13 is perfectly filled with the molten metal in the example as shown in FIG. 10 and Table 1, flowing of the molten metal is insufficient in the comparison example for solidification of the molten metal as shown in FIG. 14 and Table 1.

Next, amorphous forming state and mechanical strength of the molded product is measured under the conditions below on the example and the comparison example.

(9) Whether the part of the molded product corresponding to the cavity portion is correctly amorphous or not is checked by X-ray diffraction. As a sample for X-ray diffraction, a small piece, having length of 10 mm, width of 10 mm, and thickness of 2 mm, is cut out of a position near the center of the molded plate having length of 80 mm, width of 50 mm, and thickness of 2 mm. Next, (for investigation of amorphous state near the central portion in thickness direction) the small piece is cooled with water and sanded with sand paper for a half of the thickness to make a small piece of which thickness is 1 mm. The sanded face of this sample is measured by X-ray diffraction.

(10)A strip (of which length is 50 mm, width is 20 mm, and thickness is 2 mm) is cut out of the molded product as a sample, and three-point bending destruction test was conducted with a universal tester (a testing machine with which compression test, bending test, etc. are conducted along with tensile test) made by INTESCO CO., LTD. Test conditions are span of 30 mm and test speed of 1 mm/min. And, in the comparison example, thickness of the molded product becomes too large to be tested as it is because flowing of the molten metal is insufficient and closing of the mold is imperfect. So a product, molded under condition that thickness of the product becomes 2 mm by perfect closing of the mold with reduced charge of the metal material, is used.

Figure 15:
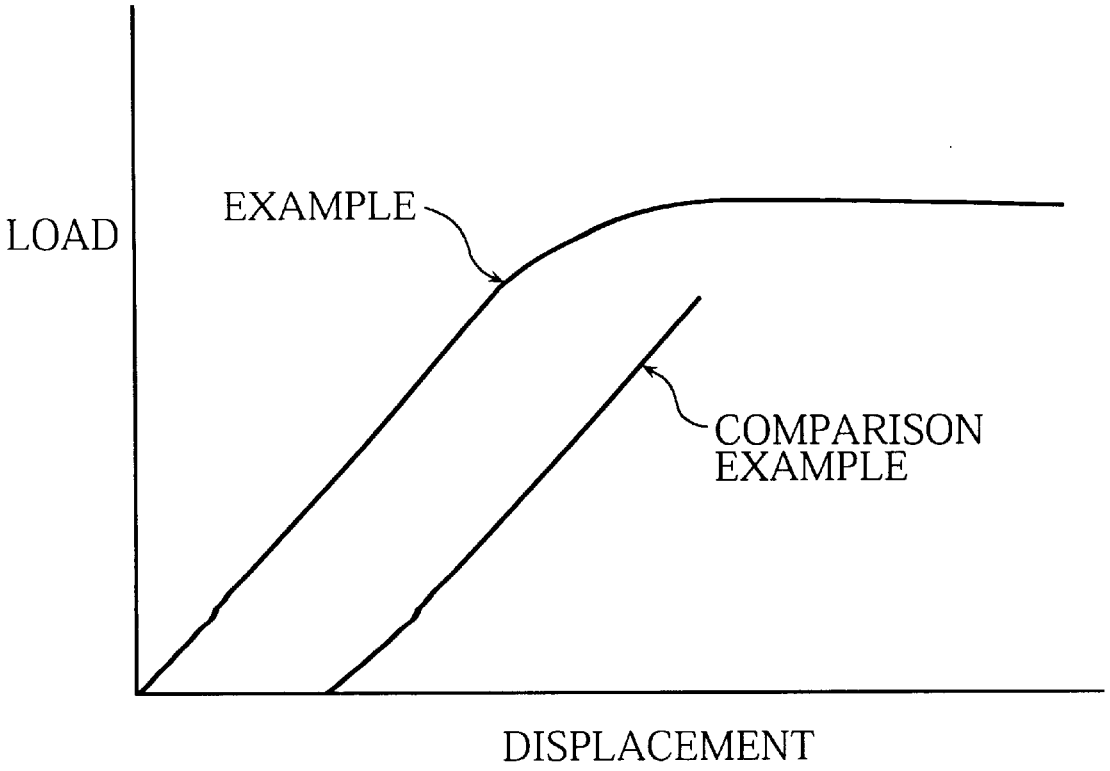
FIG. 15 is a graph showing a displacement load curve.

Results of the measurement are shown in Table 2 and FIG. 15.

TABLE 2

| MOLD | AMORPHOUS FORMING STATE | MAXIMUM BENDING LOAD |
|---|---|---|
| EXAMPLE (carbon-compound copper mold) | ⊙ | 490 kgf |
| COMPARISON EXAMPLE (copper mold) | ○ | 400 kgf |

As shown in FIG. 2, amorphous formed in the example is better than that of the comparison example. And, as the result of the three-point bending destruction test, maximum bending load is greatly high in the example in comparison with the comparison example. This shows that the example has higher mechanical characteristics than that of the comparison example. Further, as shown by a displacement load curve in FIG. 15, the example shows clear quasi-elasticity while the comparison example is broken in deformation within elastic range. It is thought that very good amorphous state is obtained in the example.

Figure 16:
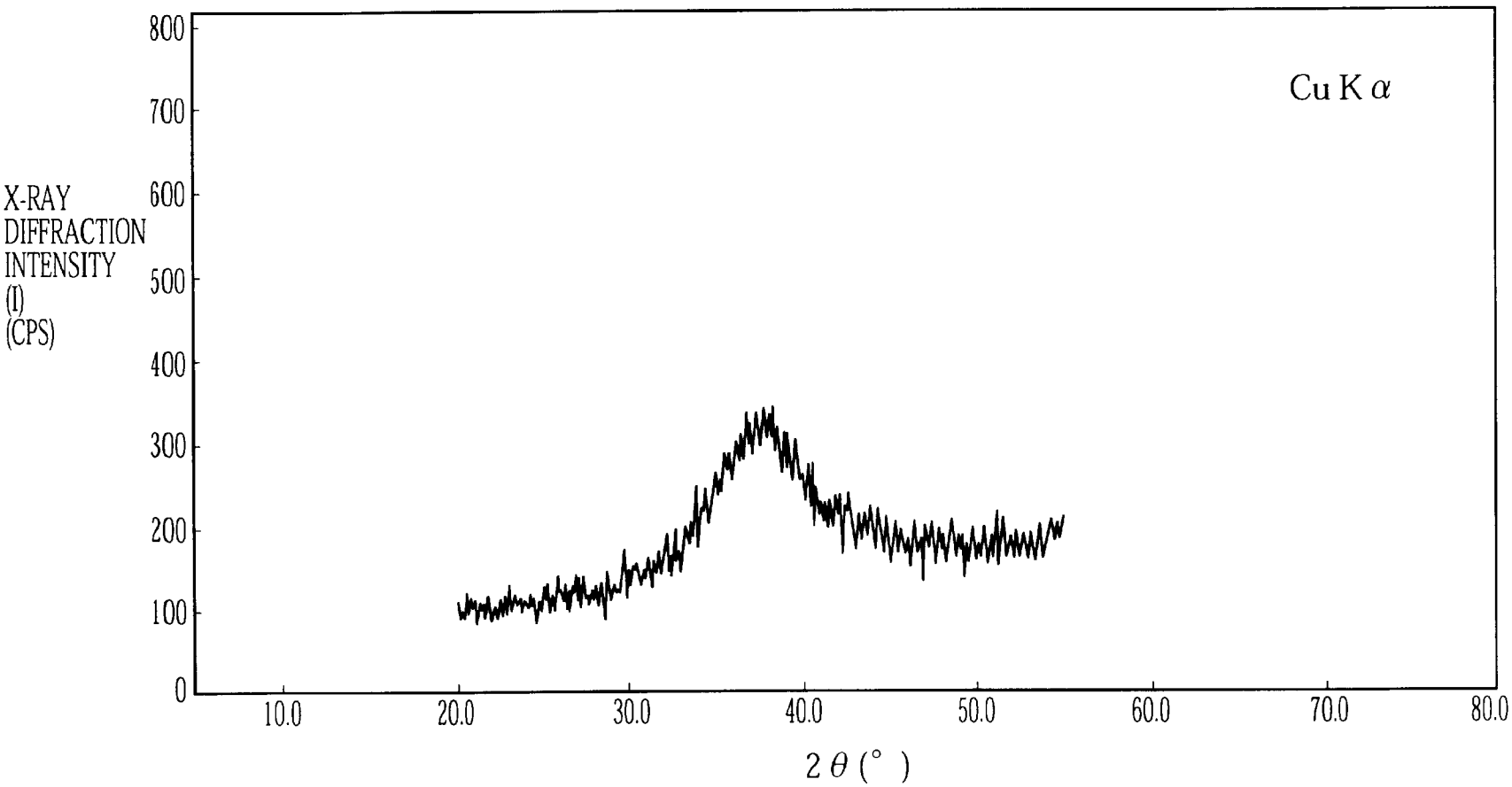
FIG. 16 is a graph showing X-ray diffraction pattern of a face parallel to surface near the central portion in thickness direction of the molded product of the example.
Figure 17:
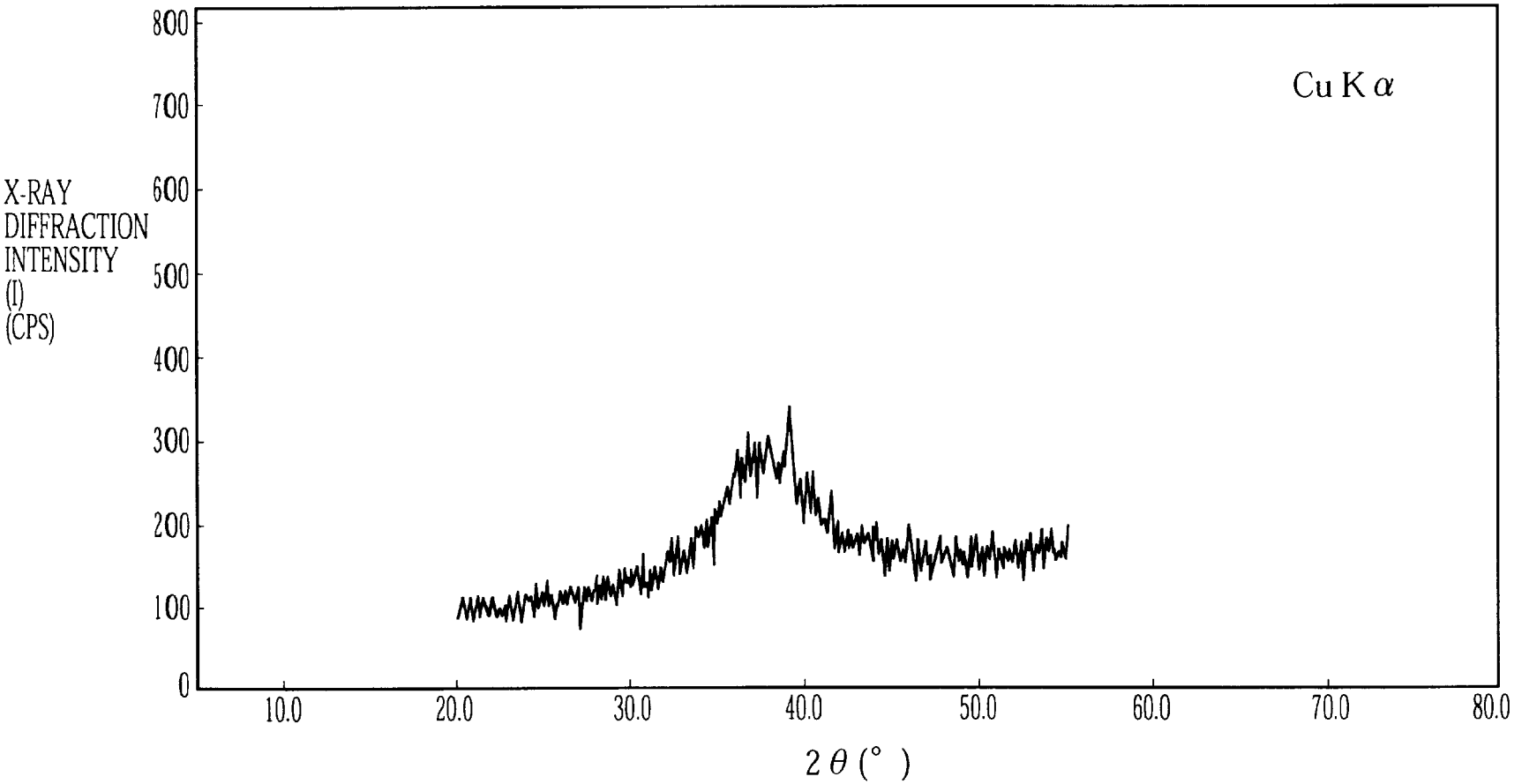
FIG. 17 is a graph showing X-ray diffraction pattern of a face parallel to surface near the central portion in thickness direction of the molded product of a comparison example.

And, results of measurement of the X-ray diffraction patterns in the example and the comparison example with the method above are shown in FIG. 16 (the example) and FIG. 17 (the comparison example). In the X-ray diffraction pattern of the example, only broad peaks are observed. This shows that the construction of the example is composed of good amorphous phase. On the other hand, in the X-ray diffraction pattern of the comparison example, acute peaks caused by crystal phase exist on broad peaks. It is thought that small crystal grains exist in the molded product. In FIG. 16 and FIG. 17, axis of abscissa shows diffraction angle ($2\theta$) and axis of ordinate shows diffraction intensity (I). And, Cu Kαmeans Kαray of Cu ($1.5429\times10^{-10}$ m) is generated by an X-ray tube of which anticathode metal is Cu (copper).

According to the manufacturing apparatus for amorphous alloy of the present invention, in the molten metal 24 fused on the portion 14 for fusing metal material of the lower mold 3, temperature decrease is greatly reduced (heat is hardly lost) after the high energy heat source is switched off. Therefore, good fluidity of the molten metal 24 is obtained in the press molding with the upper mold 2 and the lower mold 3, the molten metal 24 can be cooled at high cooling rate, and good and large (bulk) molded product of amorphous alloy 25, having excellent strength characteristics, can be obtained.

And, when the molten metal 24 is flowed into the cavity 13 by cooperation of the upper mold 2 and the lower mold 3, the molten metal 24 can be cooled rapidly further. Therefore, large (bulk) molded product of amorphous alloy 25 further excellent in strength characteristics can be obtained.

And, graphite, having low heat conductivity and high melting point, is the most preferable for the material of which the portion 14 for fusing metal material is composed, and effective to prevent temperature decrease of the molten metal 24 before molding. And the lower mold 3 can be used for a long period of time with the portion 14 made of graphite. Further, the molten metal can be fused by arc discharge because graphite has high electric conductivity. And, it is convenient that graphite is hardly combined with Zr system amorphous alloy.

Further, copper, copper alloy, silver, etc., having high heat conductivity and high melting point, are preferable for the material of which the cavity portion 13 is composed, and durable for long-term use. Especially, when the copper or copper alloy is used, there is a merit that the cavity portion 13 can be made for low cost.

According to the manufacturing method for amorphous alloy of the present invention, large (bulk) molded product of amorphous alloy 25, uniformly cooled and solidified, not mixed with crystal phase caused by ununiform solidification and ununiform nucleation, and excellent in strength characteristics such as high strength, high toughness, etc. without defection such as cold shut, is obtained because the molten metal is transformed in the predetermined configuration in one breath as. the heat of the molten metal over the melting point just after the fusion is not lost, and cooled and solidified rapidly to make the molded product of amorphous alloy 25. And, the molded product of amorphous alloy 25 is made with simple processes in one breath with good repeatability.

And, when the molten metal is transformed and cooled by the mold 1, higher cooling speed is obtained, and better large (bulk) molded product of amorphous alloy 25 excellent further in strength characteristics is obtained thereby.

While preferred embodiments of the present invention have been described in this specification, it is to be understood that the invention is illustrative and not restrictive, because various changes are possible within the spirit and indispensable features. For example, in the embodiment of FIG. 4, although the lower mold 3 having the portion 14 for fusing metal material composed of the shallow dish member 31 is shown, a through hole slightly larger than the portion 14 may be formed in the lower mold main body 32, a fitting member having heat conductivity equal to or less than 250 kcal/(m·h·° C.) may be fitted and fixed to the through hole, and the portion 14 for fusing metal material may be composed of a shallow concave portion formed on an upper face of the fitting member. And, a right half of the lower mold 3 including the portion 14 for fusing metal material shown in FIG. 4 and FIG. 5 may be composed of a material having heat conductivity equal to or less than 250 kcal/(m·h·° C.), and the portion 14 may be composed of a shallow concave portion formed on an upper face of the right half of the lower mold 3.

What is claimed is:

1. A manufacturing apparatus for amorphous alloy in which molten metal, obtained by fusing a metal material with a high energy heat source which can fuse the metal material, is transformed into a predetermined configuration, the molten metal is cooled at over a critical cooling rate simultaneously with or after being transformed and molded into the predetermined configuration, comprising:

a mold which is composed of a lower mold having a portion for fusing metal material and a cavity portion, and an upper mold which cooperates with the lower mold to press and flow the molten metal on the portion for fusing metal material into the cavity portion to mold; and the portion for fusing metal material of the lower mold is composed of a material having heat conductivity equal to or less than 250 kcal/(m·h·° C.) and the cavity portion of the lower mold is composed of a material having heat conductivity equal to or more than 270 kcal/(m·h·° C.).

2. The manufacturing apparatus for amorphous alloy as set forth in claim 1, wherein the portion for fusing metal material of the lower mold is composed of graphite.

3. The manufacturing apparatus for amorphous alloy as set forth in claim 1, wherein the cavity portion of the lower mold is composed of copper, copper alloy, or silver.

4. A manufacturing method for amorphous alloy comprising the steps of:

placing metal material on a portion for fusing metal material of a mold composed of a lower mold having the portion for fusing metal material composed of a material of which heat conductivity is equal to or less than 250 kcal/(m·h·° C.) and an upper mold which cooperates with the lower mold to press and flow molten metal on the portion for fusing metal material into a cavity portion to mold;

fusing the metal material with a high energy heat source which can fuse the metal material to obtain molten metal;

pressing the obtained molten metal over melting point with the upper mold and the lower mold to transform into a predetermined configuration; and molding the molten metal into the predetermined configuration by cooling at over a critical cooling rate simultaneously with or after transforming into a predetermined configuration, wherein the cavity portion of the lower mold is composed of a material of which heat conductivity is equal to or more than 270 kcal/(m·h·° C.).

* * * * *